United States Patent [19]

Bergen

[11] 3,944,358

[45] Mar. 16, 1976

[54] COLOR IMAGE REPRODUCTION SYSTEM

[75] Inventor: Richard F. Bergen, Ontario, N.Y.

[73] Assignee: Xerox Corporation, Stamford, Conn.

[22] Filed: Sept. 20, 1974

[21] Appl. No.: 507,909

[52] U.S. Cl. ..... 355/9; 355/4; 96/1.1; 340/173 TP; 346/74 TP; 346/74 EK; 350/162 SF

[51] Int. Cl.[2] ..... G03G 15/00

[58] Field of Search ..... 355/4, 32, 88, 9; 354/100, 354/102, 103; 96/1.1, 1.2; 340/173 TP; 346/75 TP, 74 EK; 350/162 SF

[56] References Cited

UNITED STATES PATENTS

| | | | |
|---|---|---|---|
| 2,880,268 | 3/1959 | Ballard | 340/173 TP |
| 3,322,034 | 5/1967 | Cary | 96/1.1 UX |
| 3,716,359 | 2/1973 | Sheridon | 96/1.1 |

*Primary Examiner*—Robert P. Greiner
*Attorney, Agent, or Firm*—James J. Ralabate; David C. Petre; Gaetano D. Maccarone

[57] ABSTRACT

A color image reproduction system wherein there are recorded at different angular orientations on a deformation imaging member at least two images corresponding respectively to the color content of at least two different colors of an original multicolor image. Readout illumination provided by an extended light source is converted to a plurality of point sources and deflected to the imaged member by a member comprising a transparent substrate carrying a plurality of mirrored areas. The information- modulated illumination is then reflected to provide a reproduction of the original image at an output image plane.

12 Claims, 6 Drawing Figures

FIG. 5
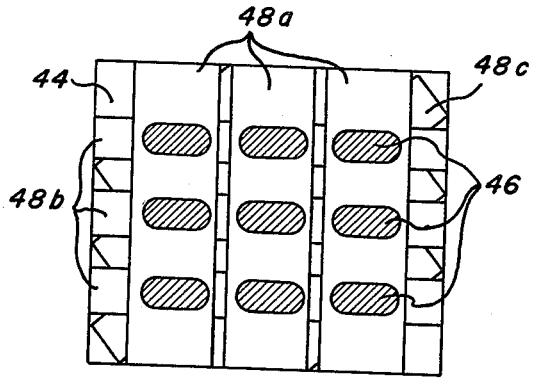
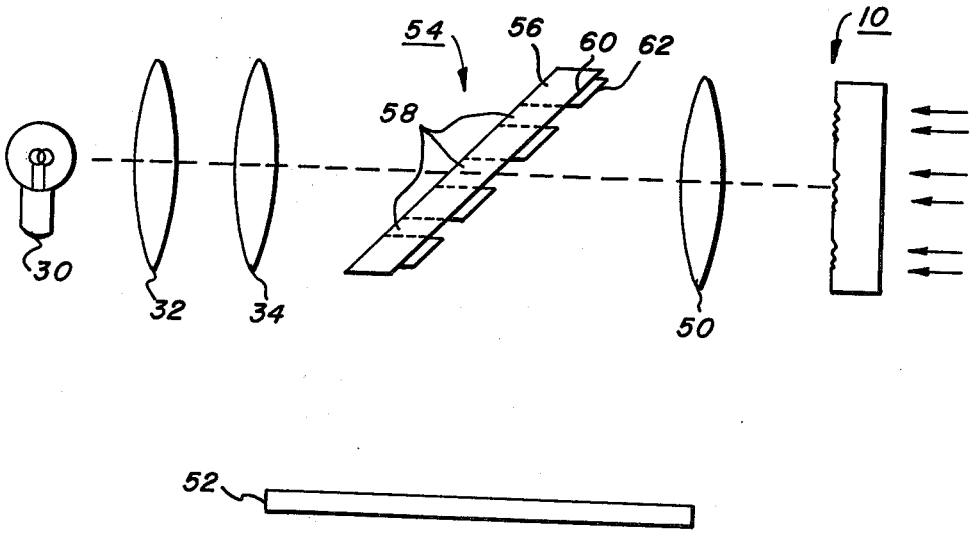
FIG. 6

COLOR IMAGE REPRODUCTION SYSTEM

BACKGROUND OF THE INVENTION

This invention relates generally to a color image reproduction system and more particularly to a system wherein images recorded by a deformation imaging member are read out with illumination from an extended light source.

There is known in the art a class of imaging members wherein a photoconductive layer and an elastically deformable elastomer layer are sandwiched between a pair of electrodes, one of which may be a thin flexible metallic layer overlying the elastomer layer. In operation imagewise activating electromagnetic radiation is directed upon the member and an electrical field is established across the photoconductive and elastomer layers thus causing these layers to deform in imagewise configuration. These members may be used as image intensifiers since the deformation image may then be read out with a high intensity light source and a schlieren optical system or for buffer storage of images since the images may be stored for some period of time. A family of imaging devices of this type is described in U.S. Pat. No. 3,716,359.

There has now been developed a color imaging system wherein there is utilized an imaging member of the type described in the Pat. 3,716,359 which further includes color spatial light modulation means and a fiber optic element. This color imaging system is described in copending Application, Ser. No. 507,910, filed on even date herewith in the name of Richard F. Bergen and assigned to a common assignee. The entire contents of this copending Application are hereby incorporated by reference herein. There is disclosed a readout scheme for full color readout wherein a point or small source readout light source is used. These small sources generally include an arc lamp or small filament bulbs. The former requires a relatively expensive power supply and large lamphouse and the latter typically has low output intensity.

Since an extended light source such as a slide projector lamp produces considerable intensity using standard voltage it would be an attractive candidate for a readout light source. However, the large area filament of such a light source would require a much higher carrier frequency for the imaging member to provide separation of the zero order from the diffracted orders on the Fourier plane of the readout lens. This in turn would typically require larger and more expensive color gratings. It would be desirable to have a readout optics system which includes an extended light source which does not have the above-noted disadvantages.

A color image reproduction system which includes such a readout optics arrangement is described in copending Application, Ser. No. 507,911, filed on even date herewith in the name of Richard F. Bergen and assigned to a common assignee. The present Application also relates to a color image reproduction system having the above-noted desirable features.

SUMMARY OF THE INVENTION

It is therefore an object of this invention to provide the above-described desirable features.

It is another object of the invention to provide a color image reproduction system.

It is a further object to provide an image reproduction system capable of providing a full color reproduction of a full color original image.

It is still another object to provide a color image reproduction system wherein an imaged member is read out with illumination provided by an extended light source and converted to a plurality of point light sources.

Still further it is an object to provide a color image reproduction system which includes a deformation imaging member.

BRIEF SUMMARY OF THE INVENTION

These and other objects and advantages are accomplished in accordance with the present invention by providing a color image reproduction system wherein there are recorded at different angular orientations on an imaging member at least two images respectively corresponding to the color content of at least two different colors of a multicolor original image. Readout illumination provided by an extended light source is converted to a plurality of point light sources and deflected to the imaged member by a member comprising a transparent substrate carrying a plurality of mirrored areas. The information-modulated illumination is then reflected through appropriate light filters to provide a reproduction of the original image at an output image plane.

BRIEF DESCRIPTION OF THE DRAWINGS

For a better understanding of the invention as well as other objects and further features thereof, reference is made to the following detailed description of various preferred embodiments thereof, taken in conjunction with the accompanying drawings wherein:

FIG. 5 is a partially schematic front view of a light deflecting and transmitting member which may be used in the color imaging system; and FIG. 6 is a partially schematic illustration of another embodiment of the color imaging system of the invention.

DESCRIPTION OF THE PREFERRED EMBODIMENTS

Figure 1:
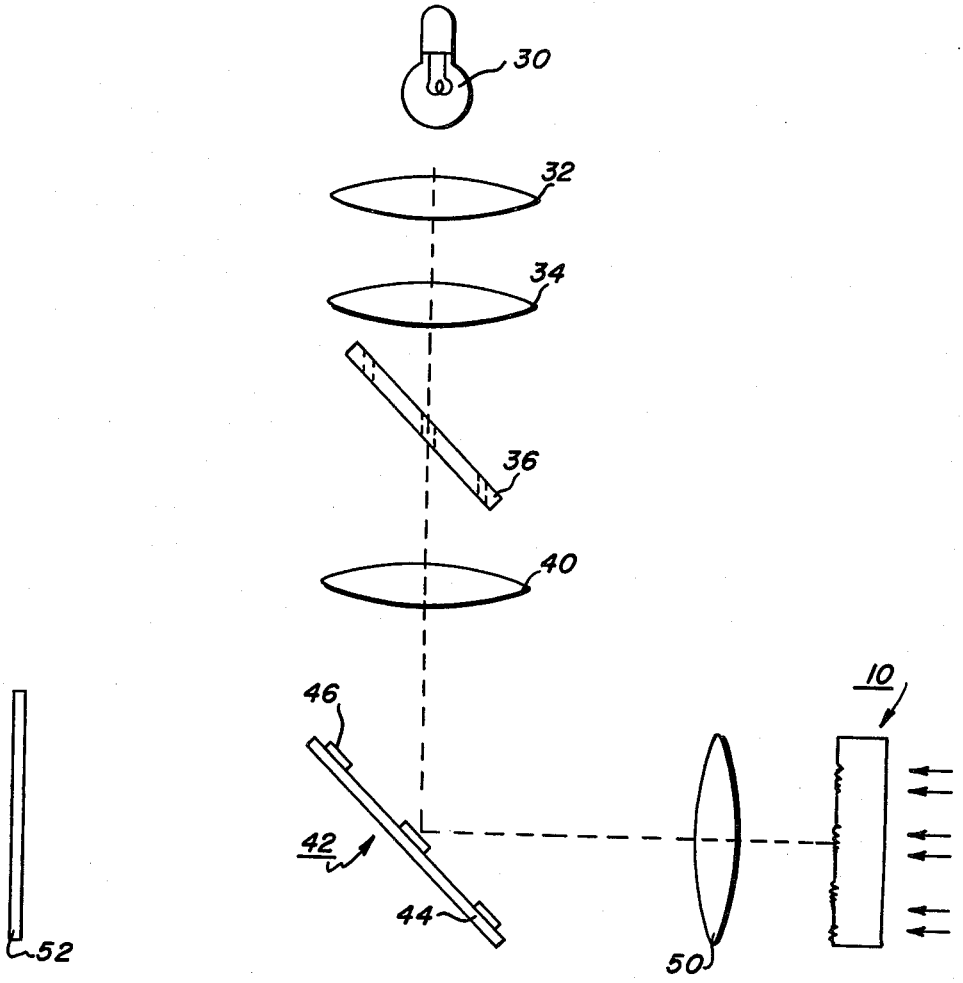
FIG. 1 is a schematic illustration of an embodiment of the color imaging system of the invention.
Figure 2:
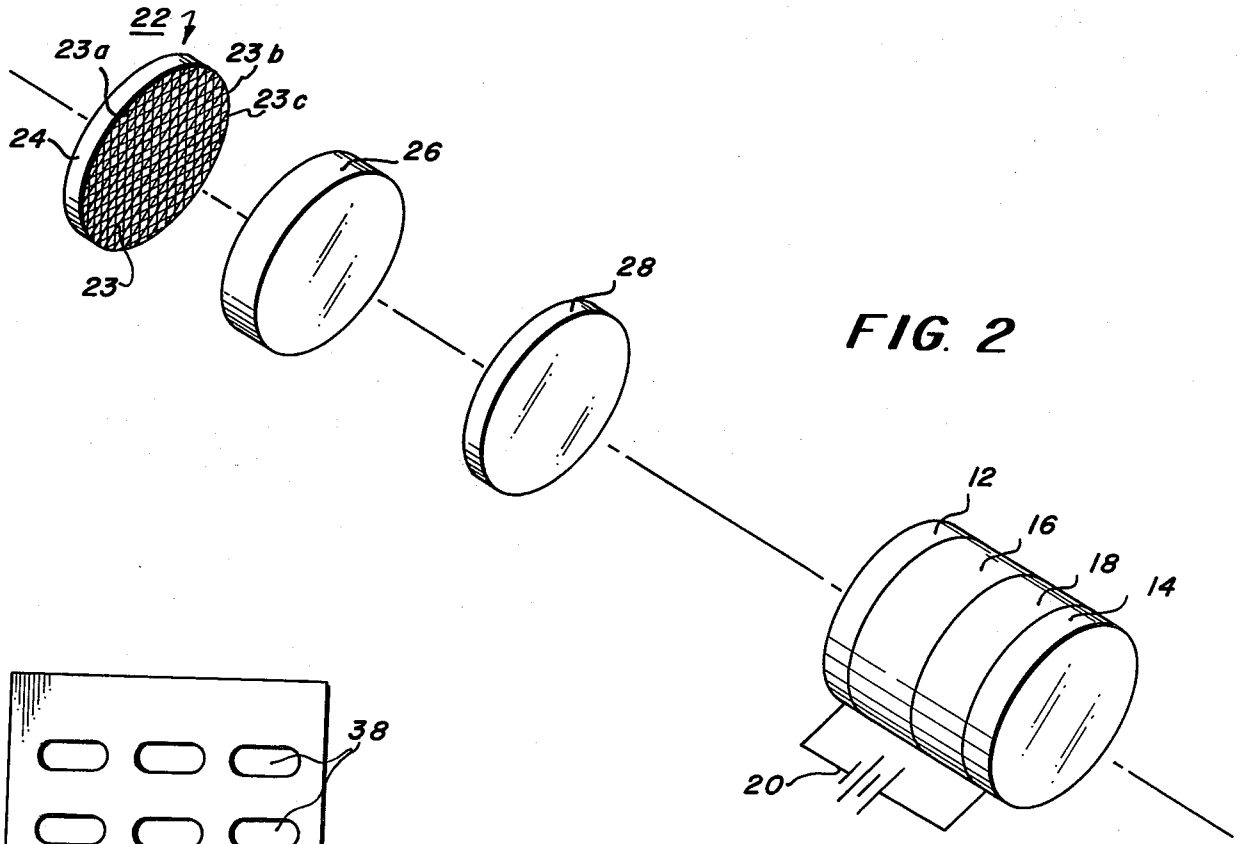
FIG. 2 is an exploded isometric view of an embodiment of an imaging member which may be used in the color imaging system.

In FIG. 1 there is illustrated an embodiment of a color image reproduction system which includes deformation imaging member 10 which may be any deformable member capable of recording screened color image input. A preferred embodiment of imaging member 10 is shown in FIG. 2 wherein the individual elements are greatly magnified for purposes of illustration. Referring now to FIG. 2 there is seen an imaging member wherein a substantially transparent conductive layer 12 comprises one electrode of the member and a thin flexible conductive metallic layer 14 comprises another electrode. It should be noted that the imaging member may further include an optical transparent substrate for conductive coating 12. Sandwiched between the electrodes are photoconductive insulating layer 16 and deformable elastomer layer 18. The electrodes are connected to potential source 20 which may be A.C., or D.C. or combinations thereof. It should be noted that the photoconductive material may be incorporated in elastomer layer 18 thus obviating the need for layer 16. The imaging member further includes color spatial light modulation means 22 comprising in this illustrative instance a three color grating 23 residing on a transparent substrate 24, e.g., glass, optional index matching liquid layer 26 and fiber optic element 28. Optionally and preferably there may also be provided a transparent layer of an insulating liquid for example, oil (not shown) in contact with the free surface of flexible conductive layer 14. The insulating liquid layer serves an important function when it has an index of refraction different than that of air since its presence over flexible conductive layer 14 means light propagating from the right of the member for reading out the image formed therein will be modulated more than it would if only air were present. The insulating liquid layer also serves as protection for flexible conductive layer 14 by isolating it from contamination by dust or the like, maintaining a more constant, ambient environment. Typically, a protective layer such as a cover glass is arranged over the insulating liquid layer to keep it in place and free of contamination. Many materials of the types useful in layers 12, 14, 16 and 18 are known in the art (see, for example, U.S. Pat. No. 3,716,359) and therefore any extensive discussion of materials is not required.

Fiber optic element 28 comprises a plurality of light conducting optical fibers secured together in side-by-side relation so that corresponding opposite ends of the fibers cooperate to define first and second faces and may be electrically insulating or conductive. The member is typically about ¼ inch thick and typically contains fibers in the range of from about 3 microns to about 20 microns in average diameter. The fibers may be of a variety of shapes including rod-like, thread-like, conical, etc. The fibers may be clad with a variety of materials including a dark colored material which will absorb light escaping from the fibers into the cladding and materials which are non light absorbing. In one embodiment some of the fibers may have a single cladding of light absorbing material and the remainder of the fibers have a single cladding of nonabsorbing material as is disclosed in U.S. Pat. No. 3,797,910. There are available fiber optic members which will transmit ultraviolet radiation; typically these members transmit visible and near infrared radiation. It is noted that a slightly reduced image contrast may be obtained because of the cladding.

The color spatial light modulation means 22 comprises a three color grating 23 residing on transparent substrate 24. The color grating is made up of three differently colored sets of stripes 23*a*, 23*b*, and 23*c* at different angular orientations superimposed on each other. Each differently colored set of stripes has a periodicity which may be the same as, or different than, the other sets of stripes. It should be noted that the color gratings may have only two sets of stripes. For purposes of illustration it will be considered that the vertical stripes 23*a* are magenta, the horizontal stripes 23*b* are cyan, and the yellow stripes 23*c* are at an angle of 45° to the magenta and cyan stripes. For the elastomer layers typically used in imaging member 10 gratings having a periodicity of 40 *l*p/mm or 100 *l*p/mm are used.

Arranged between color spatial light modulation menns 22 and fiber optic element 28 is optional index matching liquid layer 26. Layer 26 does away with any air gap which would cause resolution losses and which would typically be present unless special precautions were taken such as, for example, using pressure to force the fiber optic element into intimate contact with light modulation means 22. Accordingly, the use of layer 26 is preferred. Layer 26 is chosen so as to have an index of refraction which is relatively close or equal to that of substrate 34 (typically glass) and the glass of the fiber optic bundles (typically about 1.5–1.75). Layer 26 generally has a thickness which is less than the periodicity of the gratings (for example, a 40 *l*p/mm grating has a period of 25 microns) and preferably is as thin as possible, for example, about 1 to 2 microns. Generally any suitable liquid which has an appropriate index of refraction may be used in layer 26. Typical suitable liquids include for example, alcohols, oils such as 200 Dielectric Fluid available from Dow-Corning, water, soaps such as glycerine and index matching liquids available from Cargille Lab., Inc., Cedar Grove, N.J.

Figure 3:
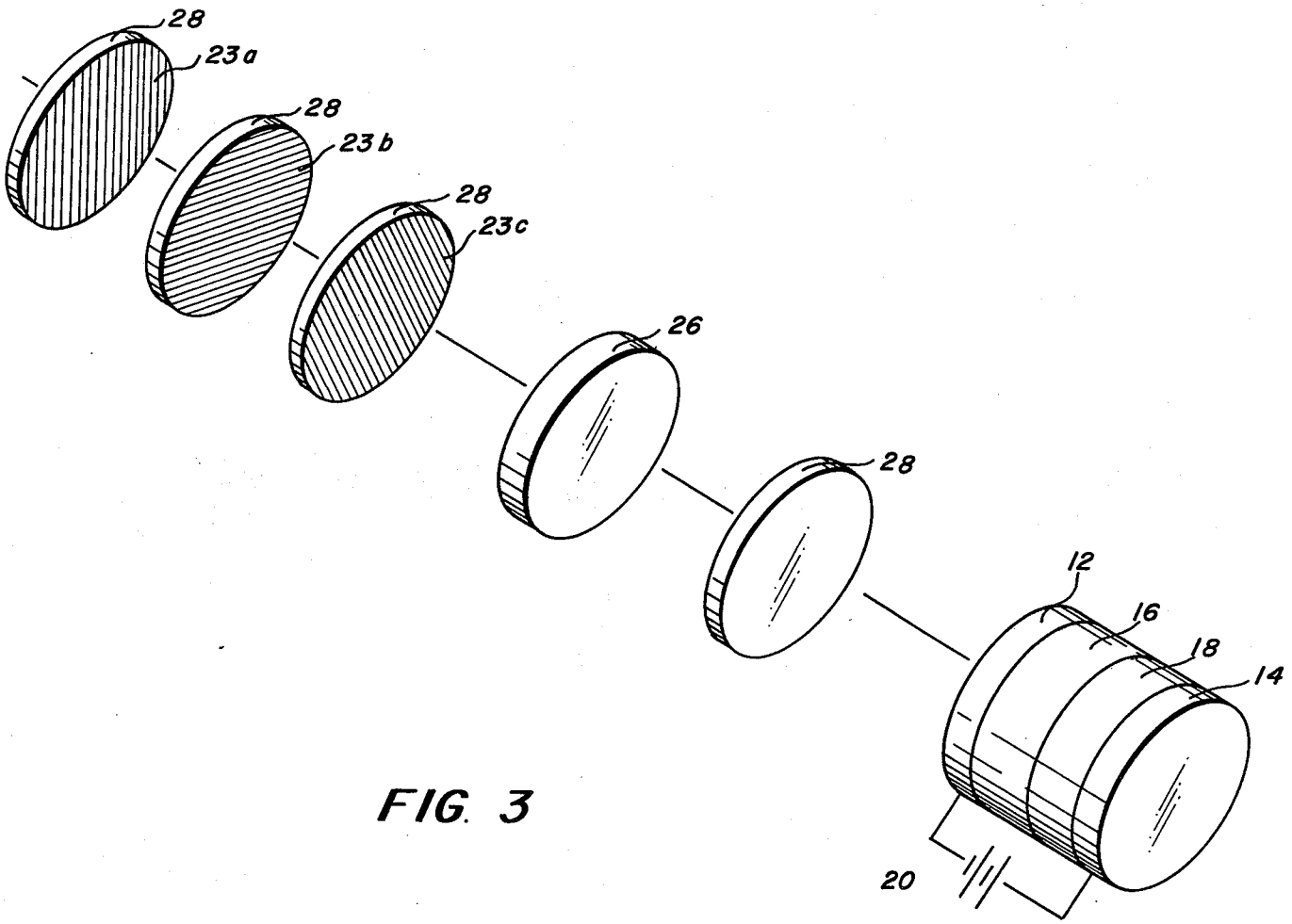
FIG. 3 is an exploded isometric view of another embodiment of an imaging member which may be used in the color imaging system.

Alternatively the color gratings may be formed directly on a surface of the fiber optic element. In FIG. 3 there is shown in exploded isometric view an embodiment of an imaging member wherein a different set of stripes, for example, magenta stripes 23*a*, cyan stripes 23*b*, and yellow stripes 23*c*, respectively resides on a separate fiber optic element 28. By using three separate fiber optic elements in the manner described it is possible to independently control the angular relationship of each color when the fiber optic elements are placed in contact with each other. Preferably an index matching layer is formed at the contact interfaces between each fiber optic element.

Color gratings such as those shown in FIG. 3 mat be formed in various ways including by a technique utilizing a photoresist material. A layer of photoresist material is formed on a surface of a fiber optic element and a master line grating, for example, one having a periodicity of 40 *l*p/mm or 100 *l*p/mm is placed in contact with the photoresist material and the member is exposed. The unexposed portions of the photoresist layer are removed resulting in a line grating being formed on the surface of the fiber optic element. The strips of photoresist material are then dyed any desired color. In another embodiment a grating of one color may be formed on one surface of the fiber optic element and a second grating of a different color mat be formed on the other surface thereof using the same techniques. Color gratings can also be made using "Polytran" commercially available from Eastman Kodak in cyan, magenta, yellow and black. This material can transfer an exposed image into a heated substrate when a slight pressure is applied to the sandwich. The "Polytran" base is then stripped from the base leaving a high resolution grating image on the substrate.

Where the color gratings are affixed to the surface of the fiber optic element opposite from that carrying electrode 12, the imaging member may be utilized in a contact imaging mode wherein a transparency is placed in contact with the surface carrying the color gratings and subsequently illuminated to excite the photoconductive layer. In another contact printing embodiment the complex color grating may be disposed at the photoconductive layer-conductive layer interface and a transparency placed in contact with the surface of the fiber optic element opposite that carrying the conductive layer.

In operation of the imaging member an electrical field is established across photoconductive layer 16 and elastomer layer 18 by applying a potential from source 20 to the electrodes. With the electrical field on an imagewise pattern of activating electromagnetic radiation (represented by the arrows) is focused at the plane between the color grating and the bottom surface of fiber optic element 28. The electrical field induces a flow of charge in the regions of the photoconductive layer 16 which are exposed thus varying the field across elastomer layer 18. The mechanical force of the electrical field causes the elastomer layer 18 to deform in a pattern corresponding to the spatially modulated image information. The thin conductive layer 14 is sufficiently flexible to follow the deformation of elastomer layer 18. As aforesaid, any deformation imaging member which is capable of recording screened color image information may be used in the inventive imaging system. Thus imaging member 10 may comprise, for example, any of the imaging members disclosed in U.S. Pat. No. 3,716,359. The images recorded in the imaging member are in the form of surface deformation phase gratings arranged at different angular orientations and are superimposed over each other.

Figure 4:
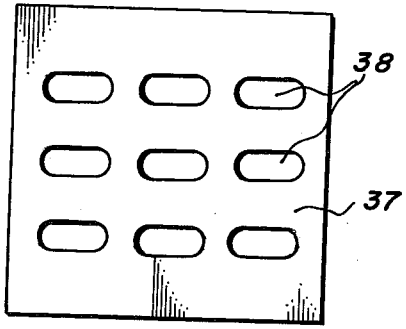
FIG. 4 is a partially schematic front view of an embodiment of a member for converting light from an extended light source into a plurality of point sources.

The image formed in imaging member 10 is read out with illumination provided by extended light source 30. The illumination passes through condenser lenses 32 and 34 and subsequently passes through an aperture plate 36 which converts it to a series of point sources. One embodiment of an element for converting the illumination from extended light source 30 to a plurality of point sources is shown in FIG. 4. Referring to FIG. 4 there is seen a member comprising opaque substrate 37 having therein a plurality of apertures 38 which may be elliptical, as illustrated, rectangular, etc. For purposes of illustration, the aperture plate 36 is shown as having nine elliptical apertures; however, it should be noted that there may be any number of apertures in the substrate and the optimum number is dependent, inter alia, upon the size of the extended light source. It is preferred that apertures 38 be elliptical or rectangular because of the angular orientation of member 36 to its optical axis.

The light from the plurality of point sources is collected by lens 40 and directed upon light deflecting and transmitting member 42 which includes a plurality of mirrored areas 46 and appropriate light filter strips. One embodiment of a light deflecting and transmitting member suitable for use in the image reproduction system of the invention is illustrated in FIG. 5. Referring now to FIG. 5 there is seen a member comprising a transparent substrate 44 carrying a plurality of mirror areas 46 and light filter strips 48. In this illustrative embodiment the vertically positioned filter strips **48*a* are red, the horizontally positioned filter strips 48*b* are green, and blue filter strips 48*c* are positioned at an angle of about 45° to the red and blue filter strips. Member 42** may be constructed by attaching the filter strips to the substrate and subsequently depositing light reflecting material in the appropriate areas such as by vacuum deposition through a mask. Alternatively, the light reflecting material may be deposited on the substrate first and the filter strips then attached thereto. Of course, the light filter material should not cover the light reflecting mirrored areas. In another embodiment the light reflecting and transmitting member may have the mirrored areas on one surface of the substrate and the light filter strips on the other surface of the substrate. In this embodiment the substrate should be about ⅛ inch thick or less in order to avoid image deterioration.

Member 42 is positioned so that the plurality of point light sources generated by member 36 are imaged on the mirrored light reflecting areas 46 of member 42. Accordingly, the number of mirrored light reflecting areas 46 is equal to the number of apertures in member 36. Readout illumination striking the mirrored areas of member 42 is reflected to a readout lens 50 and directed to the imaged surface of imaging member 10. Light striking the non-deformed (typically the background) areas of the imaged surface is reflected back to the mirrored areas 46. This zero order is lost. However, light striking the deformed (typically the image) areas of the imaging member surface is diffracted into various diffracted orders, transmitted through member 42 and projected at the image plane 52 of lens 50. For imaging members which include color spatial light modulation means having periodicities of 40 *l*p/mm and a 3 inch focal length readout lens the apertures on member 36 and the mirrored areas in member 42 would typically be about ⅛ inch width on 5/16 inch centers in one direction and the size of the apertures in the other direction would be dependent on the angular relationship of member 36 in its optical axis.

The diffracted light along any diffracted axis is made up of all the colors of light present in the readout illumination. Accordingly, to provide a color reproduction of the original image at image plane appropriate light filter strips are provided at the appropriate angular orientation with respect to the angular orientation of the various color gratings (see FIG. 2) which were used to form the image in imaging member 10. For example, where the color grating was arranged in a vertical direction the image formed in the member because of the vertical color grating will provide a horizontal diffraction readout pattern. A color filter which is complementary to the vertical color grating used is arranged across the horizontal axis of the diffraction pattern provided by the image recorded because of the vertical color grating and will remove all the wavelengths from the readout illumination except those corresponding to the color of the filter thus giving the appropriate color content of the original scene at image plane 52. For example, in the embodiment described in FIG. 2 the vertically oriented color grating comprises magenta stripes **23*a*. An image corresponding to the green content of the original image is recorded by the imaging member because the magenta stripes absorb green and allow the remainder of the light to pass. Therefore, the green filter strips 48*b* arranged in the horizontal direction will allow the green color content of the original image to be formed at image plane 52. Similarly, an image corresponding to the red color content of the original image is recorded on the imaging member because of the horizontally arranged cyan grating 33*b* and red filter strips 48*a* arranged vertically give the red color content of the original image at image plane 52. Finally, an image corresponding to the blue content of the original image is recorded on the imaging member because of the yellow grating 23*c* and blue filter strips 48*c* arranged in the appropriate direction give the blue color content of the original image at image plane 52.**

Thus, there is formed at image plane 52 a full color reproduction of color transparency 16.

It will be noted that in the series of filter strips which are included in light deflecting and transmitting element 42 there is a space between each filter strip of each series. The space between the filter strips is a function of the focal length of the readout lens, the periodically of the color gratings employed to record the various color contents of the original image in the imaging member, the size of the apertures in the element which converts illumination from an extended light source to a plurality of point sources, the angular relationship of the latter element to its optical axis and the relationship between the two optical axes involved in the color image reproduction system. The number of filter strips in each series is related to the angular orientation of that series as can be seen in FIG. 5.

In the embodiment illustrated the projected full color image will be a color reproduction of the original image, that is to say, red areas of the original will appear red in the projected image, etc. However, it should be noted that the color reproduction system may be practiced in other embodiments such as, for example, where a quasi color negative reproduction is obtained from a color positive original image or where a quasi color positive reproduction is obtained from a color negative original image. By "quasi color negative" or "quasi color positive" is meant that the reproduced image will display complementary colors for all corresponding color areas of the original with the exception of those areas of the original which are black, white, or gray in which case the reproduced image will display the same color as the corresponding area of the original. For example, a white area on the original image will appear white in the reproduced image, etc. Therefore, if cyan, magenta and yellow filters are used with the same color gratings a color positive-quasi color negative or color negative-quasi color positive imaging system will be provided.

It should also be noted that the color gratings need not be an integral part of the imaging member. For example, a color grating may be placed in contact with the emulsion layer of an original transparency and subsequently an image of this combination focused upon the imaging member. The images will be recorded by the imaging member as described above.

FIG. 6 illustrates another embodiment of a color imaging system according to the invention. The system illustrated in FIG. 6 is similar to that shown in FIG. 1 with the exception that element 54 in the system of FIG. 6 is used in place of aperture plate 36 and light deflecting and transmitting member 42 of the system of FIG. 1. Element 54 comprises a transparent substrate 56, a plurality of apertures 58, (such as are shown in FIG. 4) for converting light from extended light source 30 to a plurality of point light sources, a highly reflective mirrored surface 60 and light filter strips 62 appropriately arranged. Illumination from extended light source 30 passes through condenser lenses 32 and 34 and subsequently passes through the apertures 58 of element 54 which convert it to a series of point sources. The light then enters readout lens 50 and is directed upon the imaged surface of imaging member 10. The zero order diffracted light again passes through the apertures 58 and is lost. Light striking the deformed areas of the imaged member is diffracted into various orders, passes through light filter segments 62, strikes mirrored surface 60, again passes through the light filter segments and proceeds to form an image at image plane 52. It should be noted that since the diffracted image-modulated illumination passes through the light filter segments two times, typically the light filter segments need only be about one-half as saturated as those used in the imaging system of FIG. 1. Of course, it is possible to obtain with the imaging system illustrated in FIG. 6 the image input-image output combinations described above with respect to the imaging system of FIG. 1 by selecting appropriate combinations of color gratings and color filters.

Other imaging members which may be used in the advantageous system of the present invention include those wherein the active element comprises a layer of a ferroelectric ceramic material. Such imaging members can generally be similar to that illustrated in FIG. 2 with the exception that the elastomer layer is replaced by a layer of a suitable ferroelectric material such as a piezoelectric material. For a more detailed description of piezoelectric materials useful in such an imaging member see the article entitled "Reflective-Mode Ferroelectric-Photoconductor Image Storage and Display Devices," *Applied Physics Letters*, Vol. 23, No. 2, 15 July, 1973. Other types of imaging members which may be used are frost and relief imaging members. A typical frost or relief imaging member comprises a layer of a surface deformable material such as a thermoplastic resin overlying a photoconductive layer residing on a transparent conductive substrate. Generally, it is noted that any imaging member which is capable of recording screened color image input and being read out in reflection may be used.

Although the invention has been described with respect to various preferred embodiments thereof, it is not intended to be limited thereto but rather those skilled in the art will recognize that variations and modifications may be made therein which are within the spirit of the invention and the scope of the claims. For example, the reproduction of the multicolor original image may be projected upon an apparatus capable of forming a hard copy reproduction thereof such as, for example, a color xerographic copier or the like.

What is claimed is:

1. A color optical reproduction system comprising arranged along an optical path an extended light source;

means for generating a plurality of point light sources;

means to project images of said point light sources at an image plane;

means located at the image plane of said point light sources for folding said optical path to direct light from said point sources to a deformation imaging member;

a deformation imaging member bearing multicolor information, said information comprising at least two images superimposed over each other, said images being in the form of surface deformation phase gratings arranged at different angular orientations and corresponding respectively to the color content of different colors of an original multicolor image; and light filter means for selectively transmitting to an output image plane the color content of the multicolor original image corresponding to the images recorded by the imaging member, wherein said light filter means and means for folding the optical path are parts of the same integral member.

2. The system as defined in claim 1 wherein said imaging member comprises a substantially transparent first electrode carrying a layer of photoconductive insulating material which carries a layer of elastomer material which carries a flexible conductive metallic second electrode and means for applying an electrical field across said member coupled to said electrodes.

3. The system as defined in claim 2 wherein said imaging member further includes a layer of a transparent insulating liquid over said second electrode.

4. The system as defined in claim 3 wherein said imaging member further includes a fiber optic element comprising a plurality of light conducting fibers secured together in side-by-side relationship so that corresponding opposite ends define first and second faces, one of said faces being adjacent the surface of said first electrode opposite that carrying the photoconductive layer.

5. The system as defined in claim 4 wherein said imaging member further includes, on the face of said fiber optic element opposite that adjacent said first electrode, color spatial light modulation means comprising at least two differently colored sets of stripes arranged at different angular orientations, each different set of stripes comprising alternating strips of colored areas and light transmitting areas.

6. The system as defined in claim 5 wherein said color spatial light modulation means comprises three differently colored sets of stripes.

7. A color image reproduction system comprising arranged along an optical path an extended light source;

means for generating a plurality of point light sources;

means to project images of said point light sources on a deformation imaging member;

a deformation imaging member bearing multicolor information, comprising at least two images superimposed over each other, said images being in the form of surface deformation phase gratings arranged at different angular orientations and corresponding respectively to the color content of different colors of an original multicolor image;

light filter means for selectively transmitting the color content of the multicolor original image corresponding to the images recorded by the imaging member; and means for folding said optical path to direct light transmitted by said light filter means to an output image plane, wherein said means for generating a plurality of point light sources and said light filter means and said means for folding the optical path are parts of the same integral member.

8. The system as defined in claim 7 wherein said imaging member comprises a substantially transparent first electrode carrying a layer of photoconductive insulating material which carries a layer of elastomer material which carries a flexible conductive metallic second electrode and means for applying an electrical field across said member coupled to said electrodes.

9. The system as defined in claim 8 wherein said imaging member further includes a layer of a transparent insulating liquid over said second electrode.

10. The system as defined in claim 9 wherein said imaging member further includes a fiber optic element comprising a plurality of light conducting fibers secured together in side-by-side relationship so that corresponding opposite ends define first and second faces, one of said faces being adjacent the surface of said first electrode opposite that carrying the photoconductive layer.

11. The systen as defined in claim 10 wherein said imaging member further includes, on the face of said fiber optic element opposite that adjacent said first electrode, color spatial light modulation means comprising at least two differently colored sets of stripes arranged at different angular orientations, each different set of stripes comprising alternating strips of colored areas and light transmitting areas.

12. The system as defined in claim 11 wherein said color spatial light modulation means comprises three differently colored sets of stripes.

* * * * *